US011096492B2

(12) United States Patent
Brais et al.

(10) Patent No.: US 11,096,492 B2
(45) Date of Patent: Aug. 24, 2021

(54) OSCILLATION SYSTEM FOR CHAIRS

(71) Applicant: CO.FE.MO. INDUSTRIE S.R.L., Castegnato (IT)

(72) Inventors: Mauro Brais, Castegnato (IT); Paolo Salvoni, Castegnato (IT)

(73) Assignee: CO.FE.MO. INDUSTRIE S.R.L., Castegnato (IT)

( * ) Notice: Subject to any disclaimer, the term of this patent is extended or adjusted under 35 U.S.C. 154(b) by 0 days.

(21) Appl. No.: 16/649,606

(22) PCT Filed: Sep. 28, 2018

(86) PCT No.: PCT/IT2018/050179

§ 371 (c)(1),
(2) Date: Mar. 20, 2020

(87) PCT Pub. No.: WO2019/069336

PCT Pub. Date: Apr. 11, 2019

(65) Prior Publication Data

US 2020/0268155 A1 Aug. 27, 2020

(30) Foreign Application Priority Data

Oct. 6, 2017 (IT) ..... 102017000112144

(51) Int. Cl.
*A47C 1/032* (2006.01)

(52) U.S. Cl.
CPC ..... *A47C 1/03272* (2013.01); *A47C 1/03255* (2013.01)

(58) Field of Classification Search
CPC ..... A47C 1/03272; A47C 1/03255
(Continued)

(56) References Cited

U.S. PATENT DOCUMENTS 2,363,935 A * 11/1944 Boerner ..... A47C 1/025 297/300.5
4,384,741 A * 5/1983 Flum ..... A47C 1/026 297/300.5

(Continued)

FOREIGN PATENT DOCUMENTS

CH 701715 A2 * 2/2011 ..... A47C 1/03272
DE 202013100574 U1 * 5/2014 ..... A47C 7/443

(Continued)

OTHER PUBLICATIONS

International Search Report and Written Opinion for PCT/IT2018/050179, dated Dec. 12, 2018.

*Primary Examiner* — Jose V Chen
(74) *Attorney, Agent, or Firm* — Merchant & Gould P.C.

(57) ABSTRACT

An oscillation system (1) for chairs includes a backrest support (3) oscillating about a rotation axis (4), a first support element (6) of the seat coupled to the frame (2) to assume, in the at rest position of the backrest support (3), a plurality of relative vertical positions with respect to the frame (2) depending on, and by effect of, a weight force applied to the first support element (6). A first elastic element (21) opposes an elastic reaction to the backrest support oscillation with respect to an at rest position of the backrest support (3). A lever (31) connects to the first support element (6) to be rotated by the first support element (6) during variation of the relative position, and connects to the first anchoring end (22) to displace the first anchoring end (22). A fulcrum axis (60) does not coincide with the rotation axis (4).

11 Claims, 10 Drawing Sheets

(58) Field of Classification Search
USPC .... 297/285, 296, 300.5, 300.1, 300.2, 300.4
See application file for complete search history.

(56) References Cited

U.S. PATENT DOCUMENTS 4,479,679 A * 10/1984 Fries ..... A47C 1/03266 297/300.5
4,653,806 A * 3/1987 Willi ..... A47C 1/03255 297/300.5
4,709,962 A 12/1987 Steinmann
4,709,963 A * 12/1987 Uecker ..... A47C 1/03255 297/300.5
4,761,033 A * 8/1988 Lanuzzi ..... A47C 1/03255 297/300.3
4,962,962 A * 10/1990 Machate ..... A47C 31/126 297/300.5
4,986,601 A * 1/1991 Inoue ..... A47C 1/03283 297/300.4
5,080,318 A * 1/1992 Takamatsu ..... A47C 3/026 248/598
5,224,758 A * 7/1993 Takamatsu ..... A47C 31/126 297/300.5
5,288,138 A * 2/1994 Stulik ..... A47C 1/03255 297/302.1
5,294,178 A * 3/1994 Bogle ..... A47C 1/03255 297/302.4
5,295,731 A * 3/1994 Dauphin ..... A47C 7/42 297/440.16
5,397,165 A * 3/1995 Grin ..... A47C 1/03255 297/300.5
6,238,000 B1 * 5/2001 Hallmark ..... A47C 1/03238 297/300.5
7,600,814 B2 * 10/2009 Link ..... A47C 1/03255 297/300.2
2002/0158495 A1 * 10/2002 Kazuyoshi ..... A47C 1/03255 297/300.4
2004/0140703 A1 * 7/2004 Bock ..... A47C 1/03272 297/300.5
2004/0160101 A1 * 8/2004 Thole ..... A47C 1/03274 297/300.4
2005/0156453 A1 * 7/2005 Lin ..... A47C 3/026 297/300.5
2007/0069565 A1 * 3/2007 Diffrient ..... A47C 31/126 297/300.5
2007/0108820 A1 * 5/2007 Ueda ..... A47C 7/445 297/300.5
2007/0290537 A1 * 12/2007 Lin ..... A47C 1/03294 297/300.2
2012/0062006 A1 * 3/2012 Hall ..... A47C 1/03272 297/300.5
2015/0201758 A1 * 7/2015 Serber ..... A47C 1/024 297/300.6

FOREIGN PATENT DOCUMENTS

EP 1358821 A1 11/2003
WO 2009/153811 A1 12/2009
WO 2010/097818 A1 9/2010
WO 2016/166728 A1 10/2016
WO 2017/064619 A1 4/2017

* cited by examiner

1

OSCILLATION SYSTEM FOR CHAIRS

This application is a National Stage Application of PCT/IT2018/050179, filed Sep. 28, 2018, which claims the benefit of Italian Patent Application No. 102017000112144, filed Oct. 6, 2017, and which applications are incorporated herein by reference. To the extent appropriate, a claim of priority is made to each of the above-disclosed applications.

BACKGROUND OF THE INVENTION

The present invention relates to an oscillation system for chairs, in particular of the type in which the intensity of the reaction of the system itself to a given oscillation is self-adjustable.

There are known chairs, in particular for office, which comprise an oscillation system comprising a rigid frame bound to a base resting on the ground, a backrest support oscillating with respect to the frame and a seat support.

SUMMARY OF THE INVENTION

In some embodiments, in the jargon called "permanent contact", the seat support is fixed (or integral) with respect to the frame and only the backrest support oscillates.

In some embodiments, the seat support and the backrest support are a single oscillating body (as described for example in WO2016/166728), or two distinct but rigidly constrained bodies that oscillate in unison.

In other embodiments (in the jargon called 'synchronized systems') the seat support and the backrest support are distinct and separate from each other, and are both articulated with respect to the frame independently or (as described for example in WO 2009/153811 A1 or WO 2010/097818 A1) in a mutually constrained manner, but not rigidly, thanks to an articulation mechanism which connects them. In this way a movement of the one corresponds to a predetermined movement of the other. In some solutions, the articulation mechanism that connects the two supports is adjustable so that the relationship between the two movements can be varied. When the backrest support is oscillated due to a user's action exerted on the backrest, the oscillation system opposes itself with an elastic reaction which tends to bring the backrest support back into the at rest configuration (i.e. without force) and which must be overcome by the user. This reaction is typically obtained by means of an elastic element, for example at least one spring, interposed between the frame and the backrest and/or seat support.

There are also known (as described for example in WO2017/064619A1) oscillation systems comprising a user-actuatable adjustment system for adjusting, according to user preferences, the intensity of the reaction (in the jargon called 'stiffness') that the oscillation system opposes to a given oscillation. For example, the adjustment system can vary the degree of preload (e.g. compression or extension) of the elastic element or the position of at least one anchoring point of the elastic element to the frame and/or to the backrest and/or seat support. In this way it is possible to adapt the response of the oscillation system to the user's preferences. For example, typically a light and/or weak user prefers a softer response of the oscillation system than a heavy and/or strong user.

In some known embodiments of the oscillation systems (as for example described in the aforementioned WO 2009/153811 A1 and WO 2010/097818 A1), as the user weight varies, the reaction of the system to a given oscillation is more intense the heavier the user (in the jargon this effect is called 'weighing-people'), also (and typically) in the absence of an adjustment system of the reaction of the elastic element. This can be achieved, for example, by means of kinematic mechanisms which, at the oscillation of the backrest, lift at least a portion of the seat (for example, at least the central and/or the front portion of the seat), and therefore must overcome the user weight itself.

EP1358821A1 discloses a synchronized oscillation system in which the seat support and the backrest support are coupled by a releasable locking device.

The Applicant has found that the known oscillation systems for chairs have some drawbacks and/or can be improved in some aspects.

For example, the Applicant has found that, typically, known adjustment systems necessarily require user action, in particular requiring the user to spend time adjusting the stiffness of the oscillation system, possibly including the time necessary to understand the way of functioning of the adjustment, as well as requiring the user exerting an effort for the adjustment.

For example, the Applicant has found that some known adjustment systems are not able to carry out a wide range of the reaction intensity, possibly unless the user exerts a very prolonged adjustment action.

The Applicant has also found that the 'weighing-people' oscillation systems, while not necessarily requiring manual action by the user, nevertheless present a non-optimal comfort due to the lifting movement of the seat. According to the Applicant, the system described in EP1358821A1 is excessively complex in the structure, for example due to the releasable locking system between the seat support and the backrest support, with consequent detriment to reliability and/or functionality. Moreover, this system, which is designed to vary the degree of pre-compression of the spring, does not optimally lend itself to the variation of the reaction intensity over a wide range.

An object of the present invention is to provide an oscillation system for chairs comprising an adjustment system able to vary the extent of the reaction that the oscillation system itself opposes to a given oscillation imparted by the user ('stiffness'), which solves one or more of the problems described above.

An object of the present invention is to provide an oscillation system comprising an adjustment system able to automatically vary the stiffness of the oscillation system (typically solely) as a function of the user's weight, without necessarily requiring a manual action of the user himself.

An object of the present invention is to provide an oscillation system comprising an adjustment system able to vary the stiffness of the oscillation system, which is at the same time comfortable and ergonomic, in particular with respect to the movement of the seat during the oscillation of the backrest.

An object of the present invention is to provide an oscillation system for chairs able to vary the stiffness over a wide range of values.

An object of the present invention is to provide an oscillation system for chairs comprising an adjustment system able to vary the stiffness of the oscillation system which has a compactness and/or a structural simplicity apt to be integrated into chairs having strict requirements of cost and/or weight and/or size, and which is also reliable and functional.

According to the Applicant, the problem of realizing one or more of these objects is solved by an oscillation system for chairs according to the attached claims and/or having the following features.

According to an aspect the invention relates to an oscillation system for chairs, comprising:

- a frame (e.g. rigid) intended to be associated with a base of a chair;
- a backrest support mounted on the frame to be able to oscillate about an axis of rotation (typically fixed with respect to the frame);
- a seat support mounted on the frame and distinct from said backrest support, Preferably said seat support comprises a first support element (e.g. rigid) structured to be coupled (e.g. rigidly) to the seat and coupled to said frame to assume, given an oscillation position of the backrest support, a plurality of relative positions with respect to the frame depending (solely) on, and (solely) by effect of, a weight force applied to the first support element, said relative positions having different vertical heights of the first support element with respect to the frame.

Preferably said oscillation system comprises a first elastic system operatively interposed between said frame and said backrest support, comprising a first elastic element structured to oppose an elastic reaction (typically increasing) to an (increasing) oscillation of the backrest support about said axis of rotation with respect to an at rest position of the backrest support in the absence of oscillation forces.

Preferably the oscillation system comprises an adjustment system structured to position a first anchoring end of said first elastic element depending (preferably solely) on said relative position of the first support element with respect to the frame, with said backrest support in said given oscillation position, preferably in said at rest position.

Preferably said adjustment system comprises a lever member (preferably rigid) having a fulcrum (e.g. a pin) fixed to said frame and defining a fulcrum axis, the lever member being physically connected to said first support element to be rotated by the first support element during a variation of the relative position, and being physically connected to said first anchoring end of the first elastic element, so that said rotation of the lever member induces a displacement of the first anchoring end.

Preferably said fulcrum axis does not coincide with said axis of rotation of the backrest support.

According to a further aspect, the present invention relates to a chair comprising the oscillation system according to the present invention.

The chair preferably comprises a seat for a user (rigidly) coupled to said first support element and/or a backrest (rigidly) coupled to said backrest support.

The terms vertical, horizontal, upper, lower and the like refer to a condition of normal use of a chair embodying the oscillation system of the present invention. The term 'height' refers to a distance taken along the vertical direction.

The terms front and back refer to a normal use of a chair embodying the present invention, wherein the user's legs are located at the front portion of the system.

The expression 'intensity of the elastic reaction', or briefly 'elastic reaction', refers to a quantity directly or indirectly representative of the torque value, with respect to the axis of rotation of the backrest support, applied to the backrest support and generated by the elastic system that reacts to the oscillation. Said torque depends on the elastic force vector and on the arm vector of the point of application of the elastic force with respect to the axis of rotation.

According to the Applicant, the adjustment system, thanks to the fact that it is structured to position a first anchoring end of the first elastic element as a function of the vertical position of the first support element with respect to the frame, all with the backrest stationary in a given position (typically the at rest position), allows to set the first elastic system as a function of the weight of the user sitting on the seat. In fact, the weight (vertical) force applied by the user to the seat is transmitted to the first support element and causes a variation of its vertical position relative to the frame (namely the first support element lowers with respect to the frame). The adjustment system in turn modifies, as a function of the aforesaid relative position, the spatial position of the first anchoring end of the first elastic element, thereby modifying the elastic reaction exerted by the elastic system for a given oscillation of the backrest support. For example, the variation of the spatial position with respect to the axis of rotation may induce a variation of the arm (vector) of the elastic reaction force with respect to the axis of rotation, and/or a variation of the degree of elastic deformation (compression/extension) of the elastic element for a given oscillation, and/or a variation of the direction of the elastic reaction force of the first elastic element (which causes a variation of the resulting torque and/or a variation of the constraint reactions and therefore of the overall elastic reaction exerted).

In this way, the overall elastic reaction exerted by the oscillation system for a given oscillation is adjusted as a function of the user's weight in a completely automatic way, thanks (preferably only) to the operation of the kinematic mechanisms of the adjustment system, without the necessity of the user action.

Moreover, the distance between the axis of rotation of the backrest and the fulcrum axis causes that, during the self-adjustment and the related physical displacement of the first anchoring end of the elastic element, it is possible to vary the distance of the first anchoring end with respect to the axis of rotation of the backrest support, thereby substantially varying the arm of the elastic reaction force with respect to the axis of rotation. It is noted that in case of coincidence between the two axes, as for example in EP1358821A1, it is not possible to vary this distance between the two axes.

It is also noted that the Applicant has won a belief in the art according to which the vertical lowering of the first support element during the act of sitting, for the purpose of self-adjustment, would be uncomfortable for the user. Actually, the Applicant has verified that in practice this lowering (typically a few mm, for example 15 or 20 mm) does not entail any unpleasant experience for the user.

The present invention in one or more of the aforesaid aspects may have one or more of the following preferred features.

The present invention finds application in oscillating systems with permanent contact, with a single oscillating body, with two distinct but rigidly constrained bodies or, preferably, in synchronized systems.

Preferably, said relative positions of the first elastic element are a continuum of relative positions. In other words, with the backrest support in said given oscillation position, the first elastic element can move with respect to the frame along a motion with a vertical component, preferably substantially vertical.

Preferably, the adjustment system is structured so that, with said backrest support in said given oscillation position, a maximum height relative position of the first support element with respect to the frame corresponds to a first position of the first anchoring end of the first elastic element, for which the first elastic element opposes a first elastic reaction to the oscillation of the backrest support from the at rest position. Preferably in the first position the distance between the first anchoring end and the axis of rotation is minimal. In this way the arm of the elastic force developed by the first elastic element is minimal, as it is the resulting torque.

Preferably the adjustment system is structured so that a relative minimum height position of the first support element with respect to the frame corresponds to a second position of the first anchoring end of the first elastic element, for which the first elastic element opposes a second elastic reaction to the oscillation of the backrest support from the at rest position, the second elastic reaction being greater than the first elastic reaction. Preferably, the distance between the first anchorage end and the axis of rotation in the second position is greater than the corresponding distance in the first position. In this way the arm of the elastic force developed by the first elastic element is greater (stiff system), as it is the resulting torque.

Preferably the adjustment system is structured so that each relative position of the first support element intermediate between the minimum and the maximum height position corresponds to one and only one position of the first end of the elastic element intermediate between the first and the second position for which the first elastic element opposes an elastic reaction to the oscillation of the backrest support from the at rest position intermediate between the first and the second elastic reaction.

In this way, the greater the weight of the user, which pushes down the first support element, the lower the vertical height of the first element, the greater the reaction intensity for a given oscillation.

Preferably the adjustment system comprises a second elastic system, more preferably distinct from the first elastic system, having a second elastic element operatively interposed between said frame and said first anchoring end, and structured to oppose a reaction force to a displacement of the first anchoring end from said first position (and/or to a displacement of said first support element from said vertical maximum height position). In this way the second elastic system balances the weight force (allowing the first support element to position itself in a relative equilibrium position) and, once the weight force has been removed (or for weight force below a threshold), it brings again and maintains the first supporting element in the vertical maximum height relative position and/or the first anchoring end of the first elastic element in the first position.

Typically, the second elastic system is structured to maintain said first position of the first anchoring end for values of said weight force applied to the first support element less than or equal to a threshold value (for example equal to 40 kg). For example, the second elastic element can be preloaded. In this way the adjustment system only comes into operation starting from a predetermined minimum user weight, for example set at 40 kg. Preferably the second elastic element is interposed between said frame and said first elastic element, more preferably it is (directly) abutted to said frame on one side and to said first end of the first elastic element on an opposite side.

Preferably said seat support comprises a (e.g. rigid) second support element mounted on the frame and connected (preferably in an articulated manner, that is with one or more degrees of relative freedom, as in the 'synchronized' systems) with said backrest support to move following said oscillation of the backrest support, wherein said first support element is mounted on said second support element to be able to assume a plurality of relative positions with respect to the second support element corresponding to said plurality of relative positions with respect to the frame. In this way it is realized an oscillation system in which also the seat can oscillate (synchronized). Furthermore, it is not necessary a releasable coupling system between seat support and backrest support.

Preferably said first support element is arranged in an overlying position with respect to the second support element.

Preferably the oscillation system comprises a kinematic connecting mechanism between the first support element and the second support element, or the frame, structured to allow, with the backrest support in said given oscillation position (typically the at rest position), a relative motion of the first support element with respect to the second support element, or to the frame, having at least one vertical component, in order to implement said plurality of relative positions. Preferably said relative motion is substantially vertical. Preferably said kinematic connecting mechanism comprises (e.g. consists of), for each side of the oscillation system, a first portion and a second portion respectively arranged in a front and a rear position of said frame. Preferably one or both of said first and second portion of the kinematic connecting mechanism comprises a slot formed in one among said first and second support element (or said frame) and a pin passing through said slot and integral with the other among said first and second support element (or said frame). Preferably said slot has a development with at least one vertical component, more preferably it is (substantially) vertical.

Preferably one or both said first and second portion of the kinematic connecting mechanism comprises a connecting rod hinged, at its opposite sides, respectively to said first and second support element (or said frame). More preferably at least one hinge of said connecting rod comprises a further slot (preferably horizontal) formed in one among said first and second support element, or said frame (in order to match the kinematic motion of the first and second portion of the kinematic connecting mechanism).

Preferably, said adjustment system is interposed between said first support element and said first elastic element.

Preferably said lever member has a first arm having a respective end physically connected to (and preferably in contact with) said first support element to be rotated by the first support element during said variation of the relative position, and a second arm on the side opposite to the first arm with respect to the fulcrum, wherein the first anchoring end of the first elastic element is at an end of the second arm so that said rotation of the first arm induces said displacement of the first anchoring end. In this way a simple and compact kinematic chain is created between the first support element and the first anchoring end.

Preferably the first elastic element integrally and rigidly forms part of the second arm, wherein a second anchoring end of the first elastic element is (directly) abutted on the frame at the fulcrum. In this way the rotation of the first arm rigidly induces a rotation of the first elastic element around the fulcrum and the consequent displacement of the first anchoring end, which in turn induces a variation of the reaction force arm of the first elastic system with respect to the axis of rotation and, synergistically, a variation of the degree of deformation of the elastic element for a given oscillation. In this way it is obtained a wide adjustment range of the reaction force.

Preferably said first elastic system is physically interposed between said frame and at least one among said backrest support and said second support element.

Typically, the first elastic element has a second anchoring end abutted (directly or with the interposition of one or more elements which can be rigidly constrained to each other or which can have one or more degrees of relative freedom, preferably by means of a hinge) to the frame and the first anchoring end abutted (directly or with the interposition of one or more elements which can be rigidly constrained to each other or which can have one or more degrees of relative freedom) to at least one of the backrest support and the second support element.

Preferably the adjustment system comprises a slot afforded in at least one of said backrest support and said second support element, and a first pin that can slide along said slot, wherein said first anchoring end of the first elastic element is directly abutted onto said first pin. In this way, the slot acts as a guide for the aforesaid displacement of the first end of the elastic element.

Preferably said slot, in said at rest position of the backrest support, is formed like an arc of a circle with its centre in said second anchoring end. In this way the first elastic element does not change its elastic state (at rest or preloaded) during the self-regulation of the stiffness of the oscillation system. In alternative embodiments the development of the slot is designed to vary (also) the preload of the elastic element in the at rest position.

Preferably said axis of rotation lies on an extension of said arc of a circle. In this way, for any degree of stiffness, the overall elastic reaction force exerted during the oscillation does not change.

Preferably the adjustment system comprises a locking system of said first anchoring end, adapted to keep still said first anchoring end with respect to the backrest support, more preferably with respect to the slot, when said backrest support is in oscillation with respect to the at rest position. Preferably the locking system comprises a slider carrying said first pin and slidably engaging said slot, wherein respective contact surfaces between said slider and said slot (more preferably proximal to said first elastic element when working in tension), have a high friction coefficient. In this way when the system is in oscillation, the first elastic element deforms (in tension or in compression) and tends to push the two contact surfaces against each other, thus helping to prevent unwanted slippage of the slider inside the slot (and therefore of the first end of the elastic element) during the oscillation.

Preferably said first elastic element comprises an elastic body (e.g. a spring, a piston, an elastomeric body, etc.), a first fastening member and a second fastening member distinct from the first, wherein the elastic body is fixed (preferably screwed on respective external threads) at its opposite ends respectively to the first and the second fastening members.

Preferably, in said at rest position of the backrest support, said first elastic element is in a deformed position ('preload'). Preferably, in said at rest position of the backrest support, the first and the second fastening members are in contact with each other and kept pushed against each other by said first elastic element. In this way, said first elastic element, while being in a preloaded state, in the at rest position does not exert any elastic force on its fastening ends, thus allowing the first fastening end to move during self-regulation.

Preferably said first fastening member is integral (preferably in a single body) with said first arm. In this way the lever member is formed with a limited number of pieces.

Preferably the first arm of the lever member comprises a sliding member facing the first support element and structured to allow a reciprocal movement between the first support element and the lever member during said oscillation of the backrest support and/or said variation of the relative position of the first support element. Preferably the sliding member comprising a wheel having an axis of rotation on said first arm of the lever member, wherein a circular peripheral surface of the wheel is placed in contact with (an inferior surface of) said first support element. Preferably said (horizontal) axis of rotation of the backrest support is arranged in a lower (and rear) position of the frame, said first elastic element during the oscillation works by traction and said first anchoring end is arranged above said axis of rotation. In this way the structure is rational.

In an alternative embodiment, said (horizontal) axis of rotation of the backrest support is arranged in an upper (and rear) position of the frame, said first elastic element during the oscillation works in compression and said first anchorage end is arranged below said axis of rotation.

Preferably said end of the first arm of the lever member is arranged in a longitudinally central position of the seat (when mounted on the first support element), in order to work close to the barycenter. Preferably, said backrest support is rigid and rotates rigidly around said axis of rotation.

It is understood that one or more of the features described above may be present in the oscillation system in double (typically) or multiple copies, for example the oscillation system can have, at least for one or more of the aforesaid features, a median plane of symmetry arranged vertically and passing a median position of the width of the system itself.

Preferably the first elastic system comprises a third elastic element, comprising a respective elastic body, which is preferably deformed (preloaded) in the at rest position of the backrest support. In this way the elastic element exerts a residual elastic force which holds the backrest support in the at rest position and which must be won by the user to start the oscillation.

Preferably the chair comprises a floor resting base and a stem mounted on the floor resting base, said frame being rigidly mounted on an upper end of said stem.

BRIEF DESCRIPTION OF THE DRAWINGS

The features and the advantages of the present invention will be further clarified by the following detailed description of some embodiments, presented by way of non-limiting example of the present invention, with reference to the attached figures, in which.

DETAILED DESCRIPTION OF THE PREFERRED EMBODIMENTS

Figure 1:
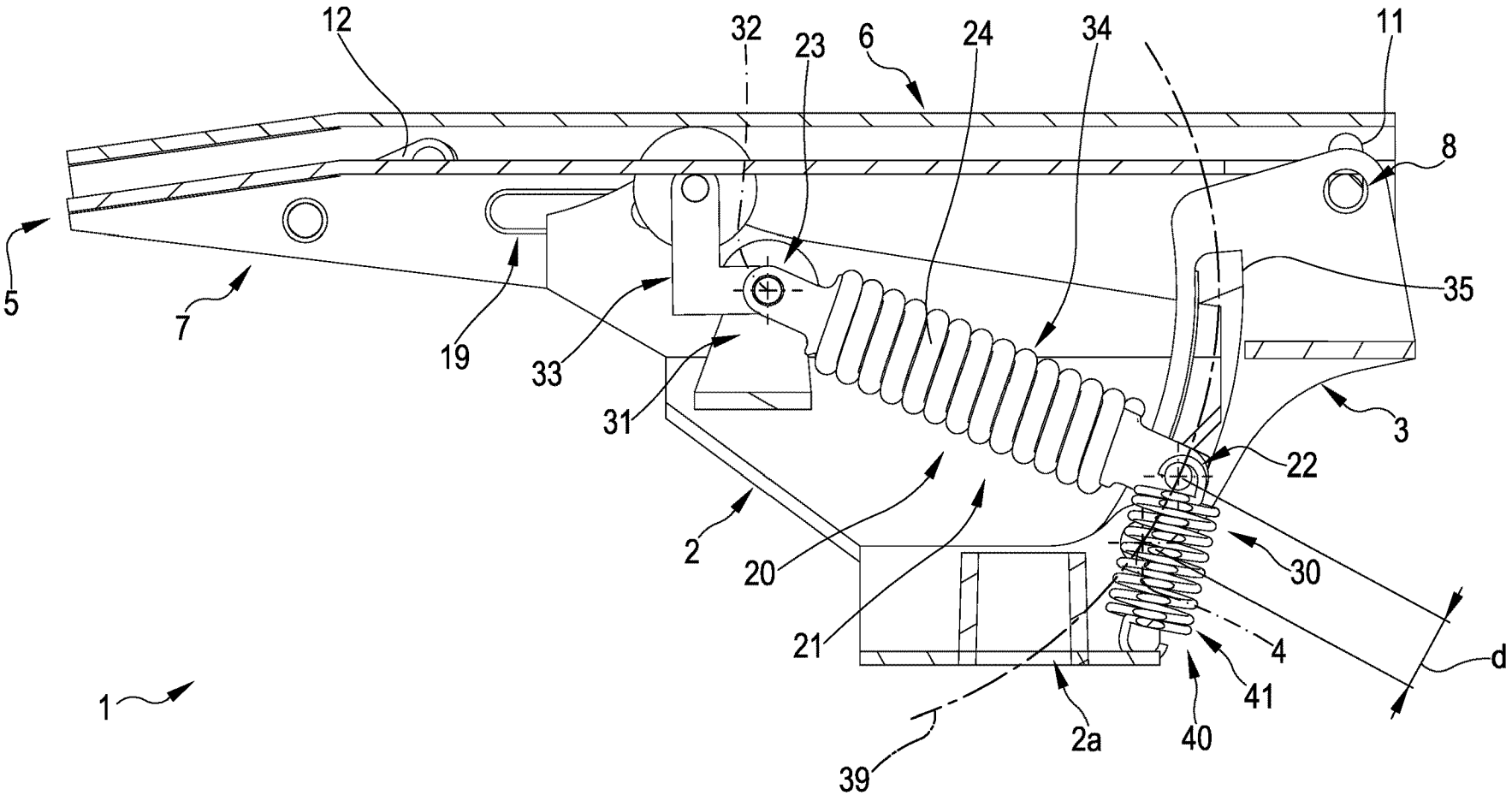
FIGS. 1 and 2 show, respectively in an at rest and maximum oscillation configuration, a schematic section on a median plane of an oscillation system according to a first embodiment of the present invention in a configuration of maximum softness, with some parts in transparency or removed.

The figures show an oscillation system 1 for chairs according to the present invention. For the purposes of exposition conciseness, the same reference numbers will be used for corresponding elements in the various embodiments.

FIGS. 1-4 show a section, on a vertical median plane, of a first embodiment of the system 1. This plane is typically a plane of symmetry for some of the components described and illustrated, such as the backrest and the seat support, the frame, as for example known in the art.

FIGS. 7-10 show a kinematic diagram of the system 1 in a second embodiment, in a side view.

The oscillation system 1 for chairs comprises a rigid frame 2 (in FIGS. 7-10 it is represented by the symbols of the 'earth') intended to be associated with a base of a chair (not shown, for example by means of a stem, not shown, which engages a suitable bore 2*a* in the frame), a backrest support 3 mounted on the frame to be able to oscillate around an axis of rotation 4 fixed with respect to the frame and a seat support 5 mounted on the frame and distinct from the backrest support 3.

The illustrated examples show "synchronized" oscillation systems.

For this purpose, the seat support 5 comprises a first support element 6, rigid, structured to be rigidly coupled to the seat (not shown) and a second support element 7, rigid, mounted on the frame and connected in an articulated way with the backrest support 3 to rotationally translate following the oscillation of the backrest support. In the shown examples, the second support element 7 and the backrest support 3 are connected by means of a hinge 8 which is movable with respect to the frame. In the example shown in FIGS. 1-5, the hinge 8 is formed by a rod 18, integral with the two bodies and acting as a pivot of relative rotation between the two bodies.

The second support element 7 is exemplarily directly mounted on the frame 2 by means of a slider 19 (shown only symbolically in FIGS. 7-10) which allows the rotational translation of the second support element with respect to the frame.

In the example of FIGS. 1-5, the slider 19 is formed by a pin 9 integral with the frame which engages a slot 10 (in the example straight and horizontal, although it may have any shape and orientation, for example to give a weighing-people effect) afforded in the second support element 7.

In alternative embodiments, not shown, the second support element may be integral with the backrest support and it may also rotate about the axis of rotation.

Advantageously, the first support element 6 is directly mounted, in an overlying position, on the second support element 7 to assume, given an oscillation position of the backrest support, a plurality of relative positions with respect to the second support element 7, and therefore with respect to the frame 3, depending only on, and solely by effect of, a weight force applied to the first support element 6, wherein the relative positions have different vertical heights of the first support element 6 with respect to the second support element 7 and/or to the frame 3.

Preferably the oscillation system comprises a kinematic connecting mechanism between the first support element 6 and the second support element 7, to allow, with the backrest support in said oscillation position, preferably in the at rest position, a relative motion of the first support element 6 with respect to the second support element 7 having at least one vertical component, in order to implement the plurality of relative positions.

It is observed that the first support element 6 can assume the aforesaid plurality of relative positions for at least a given oscillation position of the backrest support, preferably for each oscillation position. In other words, in each oscillation position of the backrest support, the first element can assume all the possible relative positions. Typically, as in the shown examples, the transition from one relative position to another can take place only in a specific oscillation position, preferably in the at rest position, i.e. in the absence of actions.

Preferably, but not necessarily, once a relative position is assumed in the at rest position, this relative position between the two support elements 6 and 7 is kept unchanged throughout the oscillation, the relative movement between the two support elements being prevented, as better explained later.

In the example shown in FIGS. 1-5, the kinematic connecting mechanism comprises, for each side of the oscillation system, a slot 11 afforded in a rear position of the first support element 6 and which is engaged by the aforesaid rod 8 which acts as a pin integral with the second support element 7. Preferably the slot 11 has a vertical development, so that the aforesaid relative motion is vertical.

In the example shown in FIGS. 1 to 5, the kinematic connecting mechanism comprises, in a front position thereof, a connecting rod 12 hinged at its opposite ends respectively to the first and second support elements. Exemplarily, to allow the rotation of the rod 12 during the vertical lowering of the first support element 6, a further horizontal slot 13 is afforded in the first support element 6 and it is engaged by a hinge pin 14 at the upper end of the connecting rod 12.

In the example shown in FIGS. 7-10, the kinetic connecting mechanism comprises, both in a front and in a rear position thereof, respective connecting rod 12, 15 hinged at the respective opposite ends respectively to the first and second support elements. Also in this case release slots are provided (not shown).

In alternative embodiments, not shown, the kinematic connecting mechanism can have the slot 11 at the front and the connecting rod 12 at the rear, or can comprise two slots of the type of the slot 11 respectively at the front and rear. Moreover, the slots of the type of the slot 11 or of the further slot 13 can be obtained, as an alternative, on the second support element 7.

Preferably the oscillation system 1 comprises a first elastic system 20 operatively interposed between the frame 2 and the backrest support 3, comprising a first elastic element 21 structured to oppose a growing elastic reaction to a growing oscillation of the backrest support with respect to the at rest position of the backrest support.

In the shown examples, the first elastic element 21 has a first anchoring end 22 abutted to the backrest support and a second anchoring end 23, opposite to the first one, directly abutted to the frame 2 by a hinge. In alternative embodiments, not shown, the first end can be abutted to the second support element 7 suitably shaped.

Preferably, the first elastic element 21 comprises an elastic body 24 (e.g. a spring), a first fastening member 25 and a second fastening member 26 distinct from the first one, wherein the elastic body 24 is fastened (e.g. by screwing on respective external threads) at its opposite ends respectively to the first and second fastening member.

During the oscillation, the first elastic element 21 works exemplarily by traction in the example shown in FIGS. 1-6, and in compression in the example shown in FIGS. 7-10.

In the example shown in FIGS. 1-6, in the at rest position of the backrest support 3, the first elastic element 24 is in a deformed position ('preload') and the first and second fastening members 25, 26 are in contact with each other and kept pushed against each other by the first elastic element.

The oscillation system 1 comprises an adjustment system 30 structured for positioning the first anchoring end 22 (solely) as a function of the relative position of the first support element 6 with respect to the second support element 7 (and therefore to the frame 2), with the backrest support 3 in the at rest position.

In the shown examples, the adjustment system 30 comprises a, rigid, lever member 31, having a fulcrum 32 (e.g. a pin which realizes a fulcrum axis 60 of the lever member, parallel to the axis of rotation 4, as shown in the FIGS. 1-6) fixed to the frame 3. The lever member 31 is physically connected to the first support element 6 to be rotated during the movement of the first support element from the maximum vertical height relative position, and furthermore it is physically connected to the first anchoring end 22 of the first elastic element, such that the rotation of the lever member 31 induces the aforesaid movement of the first anchorage end 22. In the example shown in FIGS. 1-6, the lever member 31 is a first kind lever.

Preferably, the lever member 31 has a first arm 33 having its respective end physically in contact with the first support element 6 to be rotated by the first support element 6 when it is lowered from the maximum vertical height relative position, and a second arm 34 on the side opposite the first arm with respect to the fulcrum.

Preferably, the first elastic element 21 makes integrally and rigidly part of the second arm 34, the first anchoring end 22 of the first elastic element 21 being at the end of the second arm 34 and the second anchoring end 23 of the first elastic element being directly abutted on the frame at the fulcrum 32 (in the example the second anchorage end coincides with the fulcrum 32). In the example shown in FIGS. 1-6, the first elastic element 21 entirely forms the second arm 34.

Preferably, the first fastening member 25 is integral (preferably in a single body) with the first arm. Preferably, the first arm 33 of the lever member comprises a sliding member 37 facing the first support element 6 and structured to allow reciprocal movement between the first support element and the lever member during the oscillation of the backrest support and/or during the variation of the relative position of the first support element. In the shown example, the sliding member is a wheel 38 with an axis of rotation on the first arm of the lever member and a peripheral circular surface in contact with a lower surface of the first support element.

In the example shown in FIGS. 7-10, the lever member 31 is a third kind lever.

Preferably, the adjustment system 30 comprises a rod 29 which connects (preferably with a slider) the first support element 6 with the lever member 31 to impress a torque to the lever member 31. A terminal end 28 of the lever member, opposite to the fulcrum 32 and suitably shaped as an arc of a circle with centre in the axis of rotation 4, engages the first anchoring end 22 to move the latter.

In further embodiments of the present invention, not shown, the lever member can be a second kind lever.

Preferably (as shown in the examples) the adjustment system 30 comprises a slot 35 afforded in the backrest support 3 and a first pin 36 which can slide along the slot, wherein the first anchoring end 22 of the first elastic element 21 is directly abutted on (or coincides with) the first pin 36. Preferably, the slot 35, in the at rest position of the backrest support, is formed like an arc of a circle 39 with centre in the hinge point of the second anchoring end 23. Preferably, the axis of rotation 4 lies on an extension of the arc of a circle.

The adjustment system thus structured realizes that, with the backrest support in the at rest position, to a maximum height relative position of the first support element 6 with respect to the second support element 7 (shown exemplarily in FIGS. 1 and 7) corresponds a first position of the first anchoring end 22 of the first elastic element 21, wherein the distance d (corresponding to the arm of the elastic force developed by the first elastic element) between the first anchoring end 22 and the axis of rotation 4 is minimal, so that the first elastic element opposes a minimal elastic reaction to the oscillation of the backrest support from the at rest position. Moreover, at a minimum height relative position of the first support element 6 with respect to the second support element 7 (shown exemplarily in FIGS. 3 and 9) corresponds a second position of the first anchoring end 22 of the first elastic element 21, wherein the aforesaid distance d is maximum, so that the first elastic element opposes a maximum elastic reaction to the oscillation of the backrest support from the at rest position. At each intermediate relative position between the minimum and maximum height positions, along a continuum of positions, corresponds one and only one position of the first end of the elastic element intermediate between the first and the second position.

Preferably the adjustment system 30 comprises a second elastic system 40 having a second elastic element 41 interposed between the frame 2 and the adjustment system 30, and structured to oppose a reaction force to a displacement of the first anchoring end 22 of the first elastic element 21 from the first position and correspondingly to a displacement of the first support element 6 from the maximum vertical height position.

Preferably, the second elastic element 41 is preloaded in the first position. During the self-adjustment, the second elastic element can work in tension (as shown in the examples of the figures) or by compression (not shown).

Exemplary, the second elastic element is directly abutted to the frame on one side and to the first end 22 of the first elastic element 21 on the opposite side.

In a possible not shown embodiment, the second elastic system can be abutted (also) at any point of the lever member 31 and/or of the first support element 6.

In a not shown embodiment, the second elastic system can comprise a torsional spring operative about the fulcrum axis 60 of the lever member 31 and/or (FIG. 7-10) about the hinge at the second anchoring end 23.

Preferably, the adjustment system 30 comprises a locking system 61 of the first anchoring end 22, comprising a slider 50 (not shown in FIGS. 7-10) carrying the first pin 36 and slidably engaging the slot 35, wherein the respective contact surfaces between the slider and the slot have a high friction coefficient. For example, the inner surface 51 of the slot 35 (proximal to the elastic element 24 for the example in FIGS. 1-6, distal from the elastic element 24 for the example in FIGS. 7-10, when the locking system is present) is treated or coated or covered with a suitable element, to have a surface like the surface of the discs in the disc brakes for vehicles, and the corresponding surface of the slider 50, or the whole slider 50, is of the type of pads in the aforementioned disc brakes.

Preferably, the first elastic system comprises (not shown) a third elastic element, comprising a respective elastic body, for example directly abutted between the frame and the backrest support in a fixed position (unlike the first elastic element). Preferably, the third elastic element is preloaded in the at rest position of the backrest support.

Figure 7:
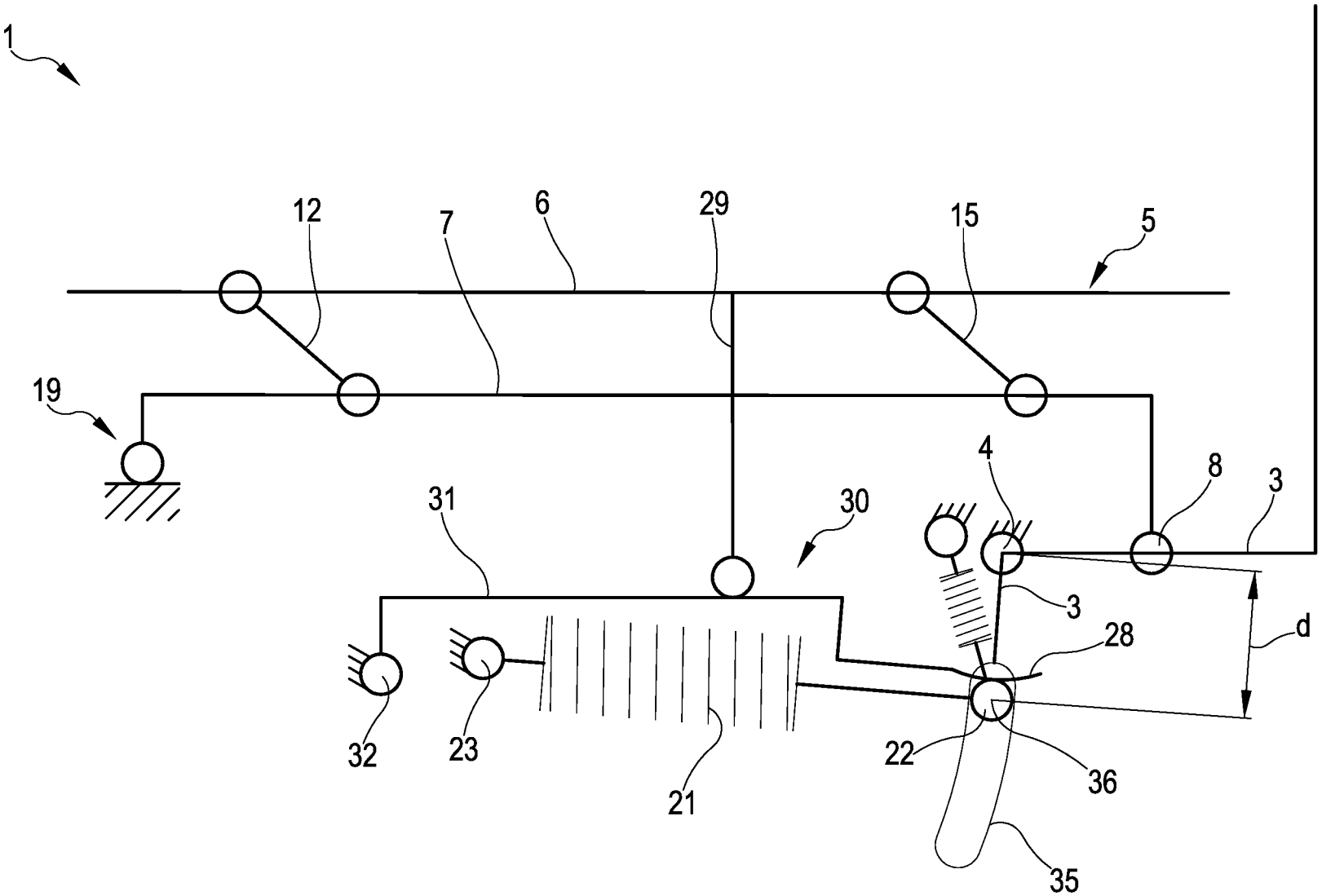
FIGS. 7 and 8 show, respectively in an at rest and maximum oscillation configuration, a diagram of an oscillation system according to a second embodiment of the present invention in a configuration of maximum softness.

In use, in the configuration shown in FIGS. 1 and 7 (at rest position and maximum softness, i.e. with minimum distance d), the backrest support is steadily held in the at rest position by the third preloaded elastic element. In the example shown in FIG. 1, the first elastic element 21, as explained, although also deformed, does not exert a traction on the backrest support thanks to the contact between the two fastening members 25 and 26. The first support element 6 is held in the maximum height relative position by the second elastic system 40, which is also preloaded.

Figure 2:
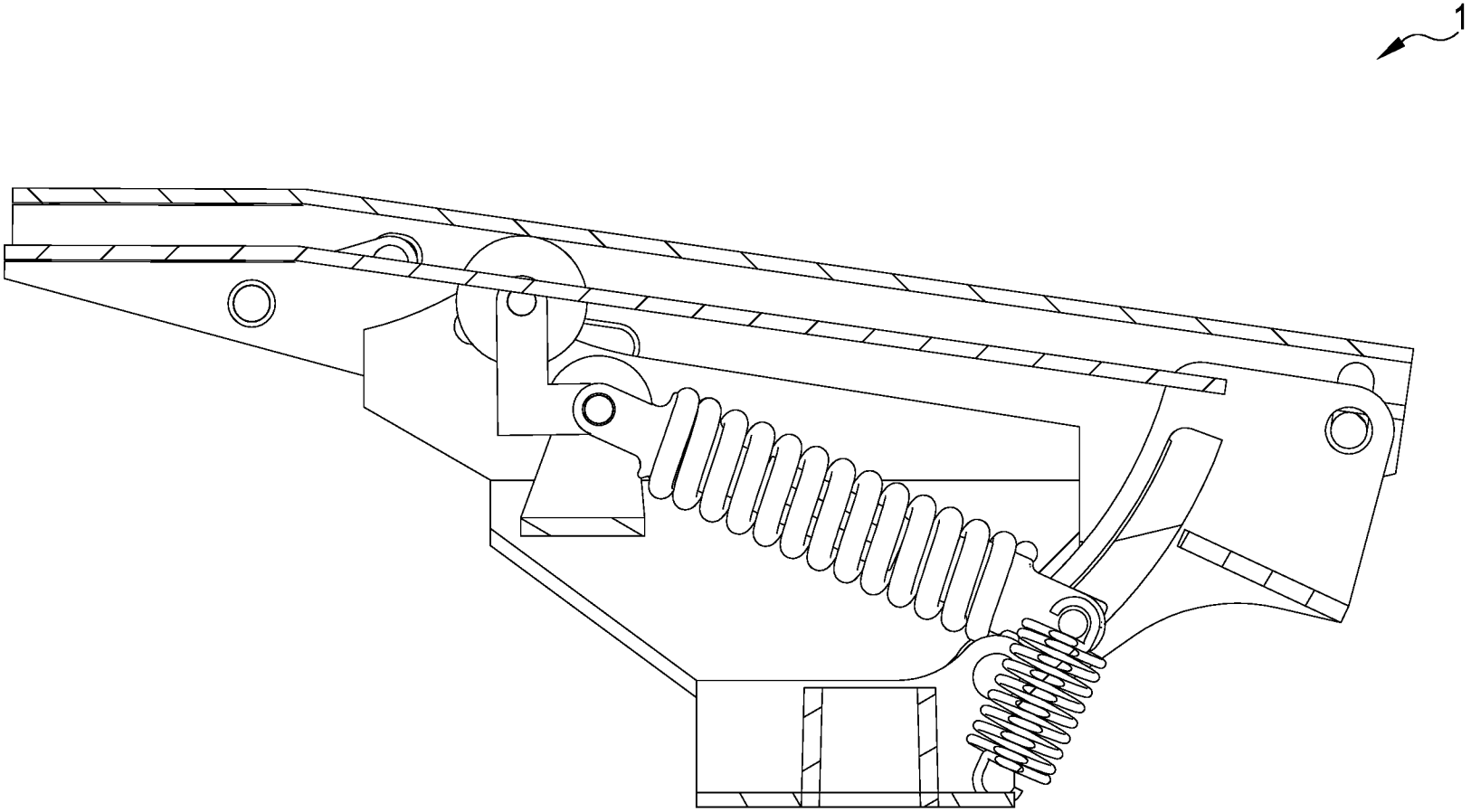
Figure 3:
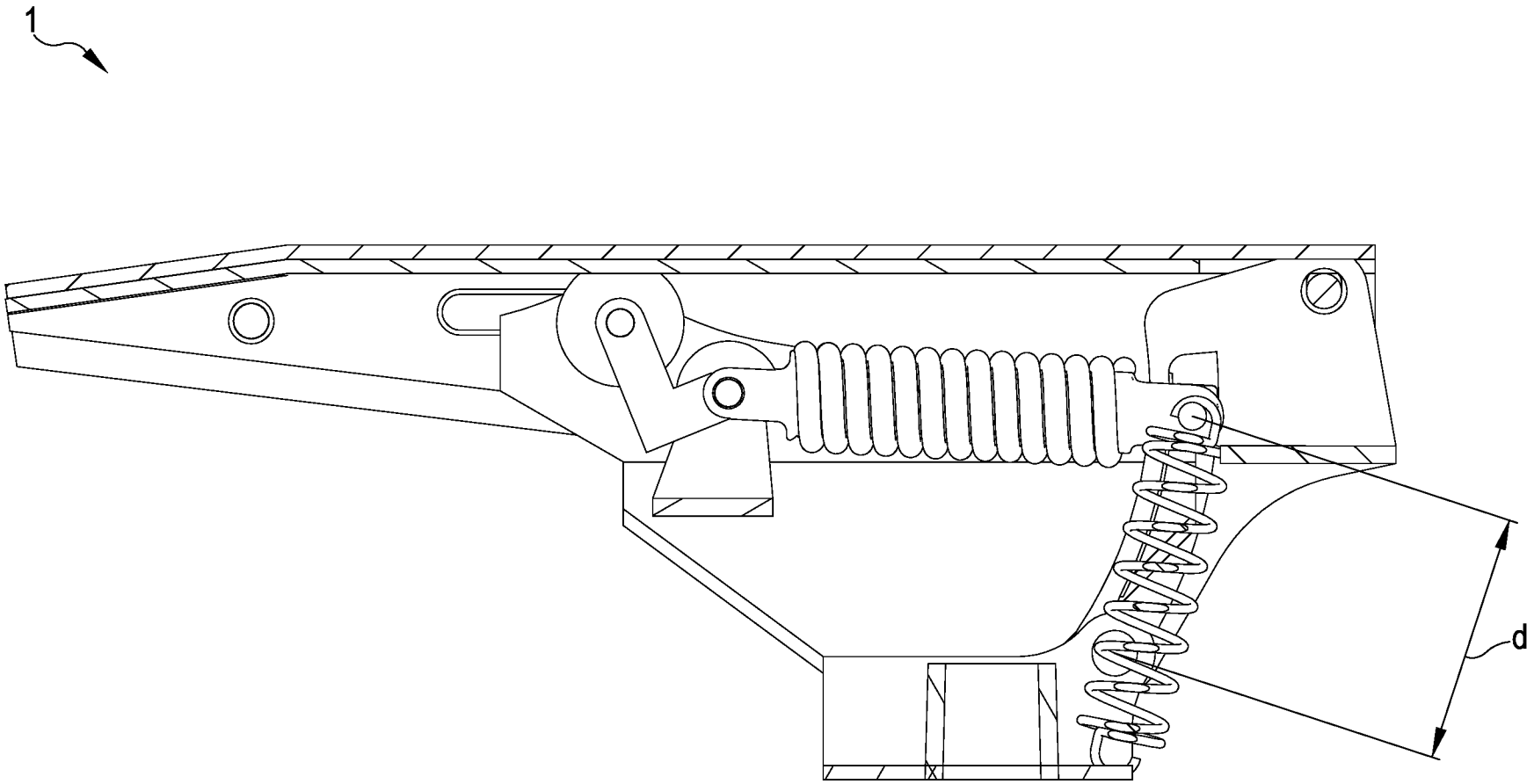
FIGS. 3 and 4 show, respectively in an at rest and maximum oscillation configuration, a schematic section on a median plane of the oscillation system of FIGS. 1 and 2 in a configuration of maximum stiffness, with some parts in transparency.
Figure 8:
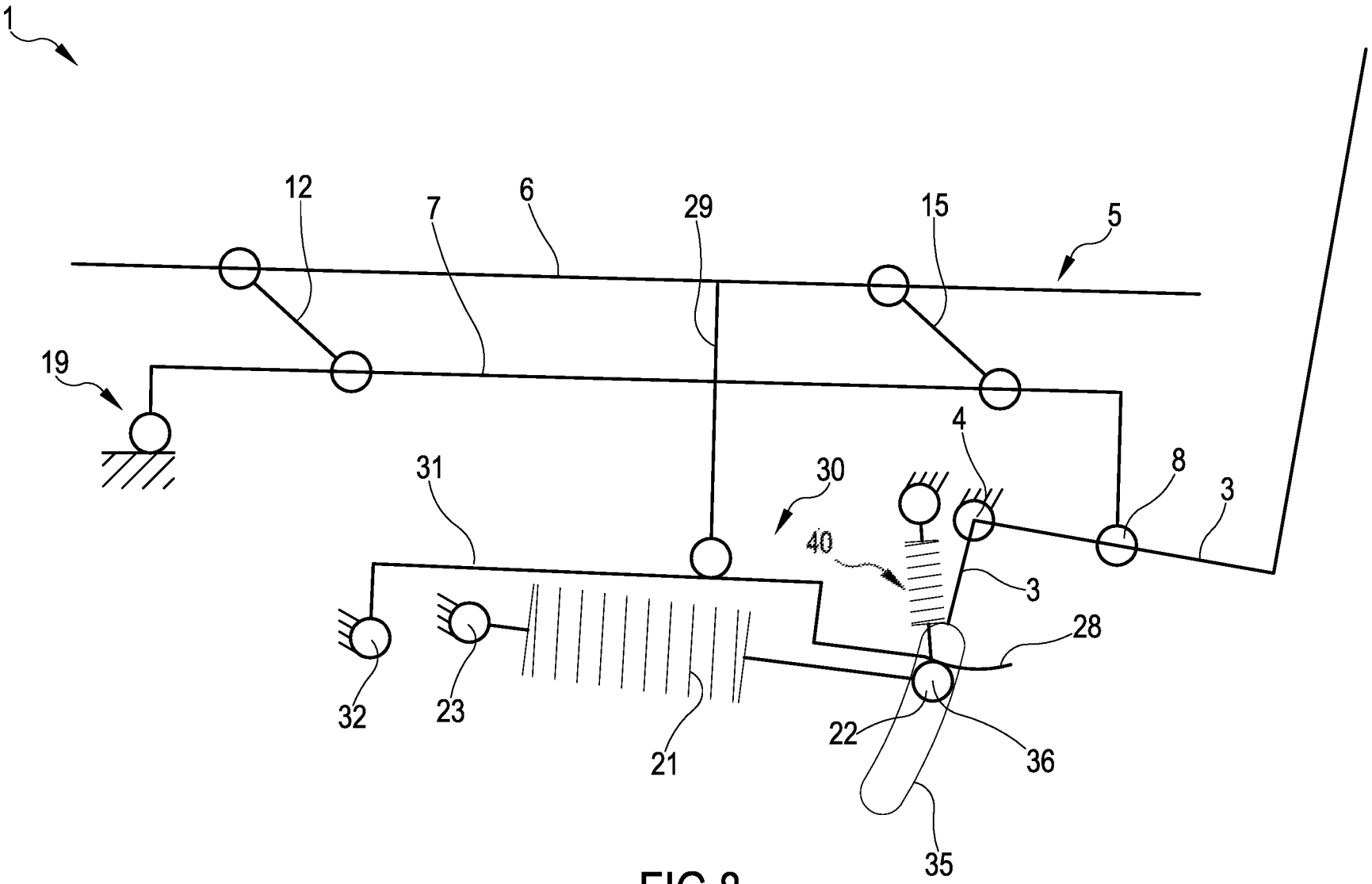
Figure 9:
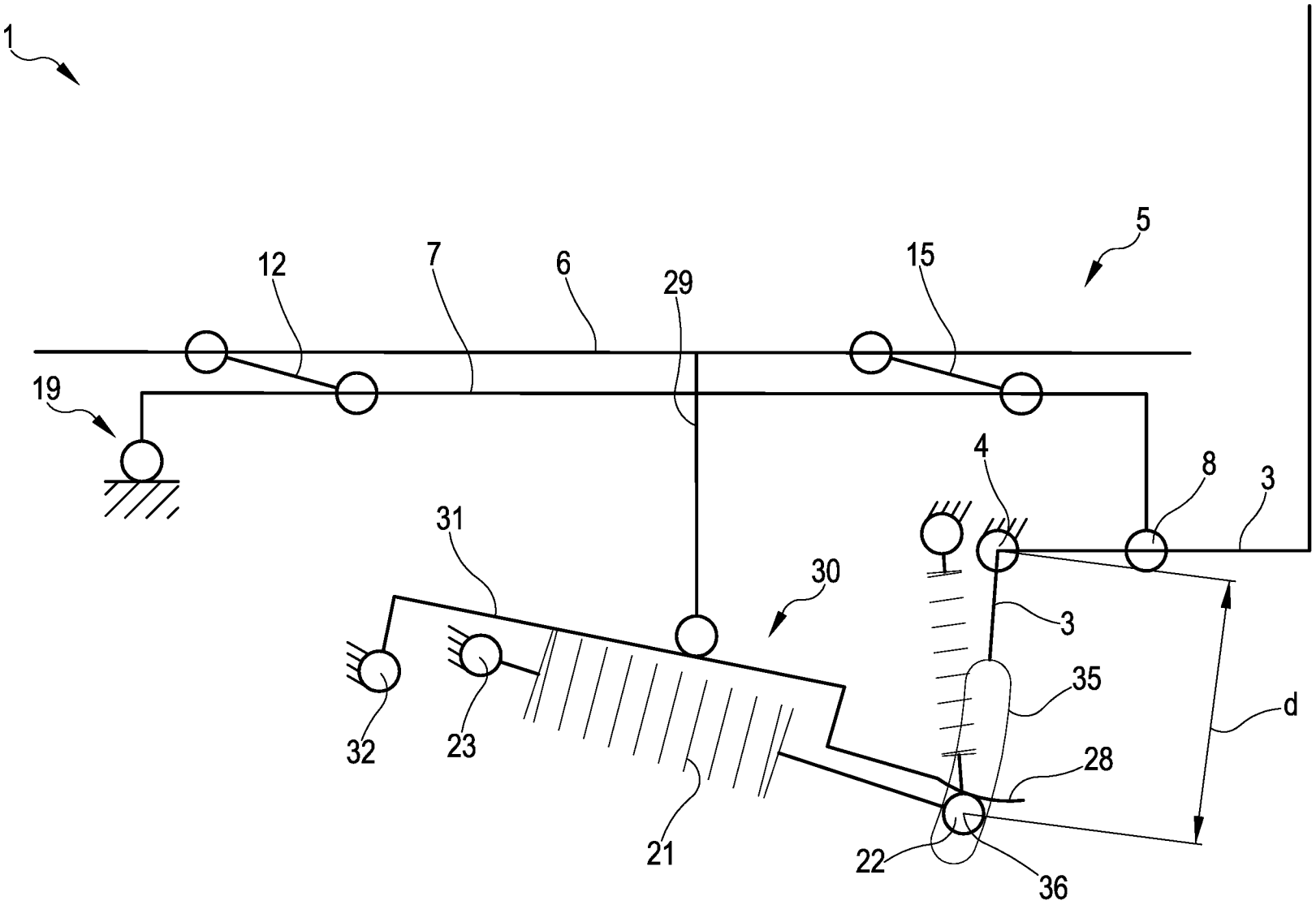
FIGS. 9 and 10 show, respectively in an at rest and maximum oscillation configuration, a diagram of the oscillation system of FIGS. 7 and 8 in a configuration of maximum stiffness.

In the case of sitting of a user who weighs less than a threshold weight (e.g. 40 kg), the first support element 6 does not lower due to the preloading of the second elastic element 41 and therefore the whole adjustment system does not operate. In case of oscillation (in FIGS. 2 and 8 shown in its maximum amplitude), the oscillation system responds with a minimum reaction torque.

Figure 4:
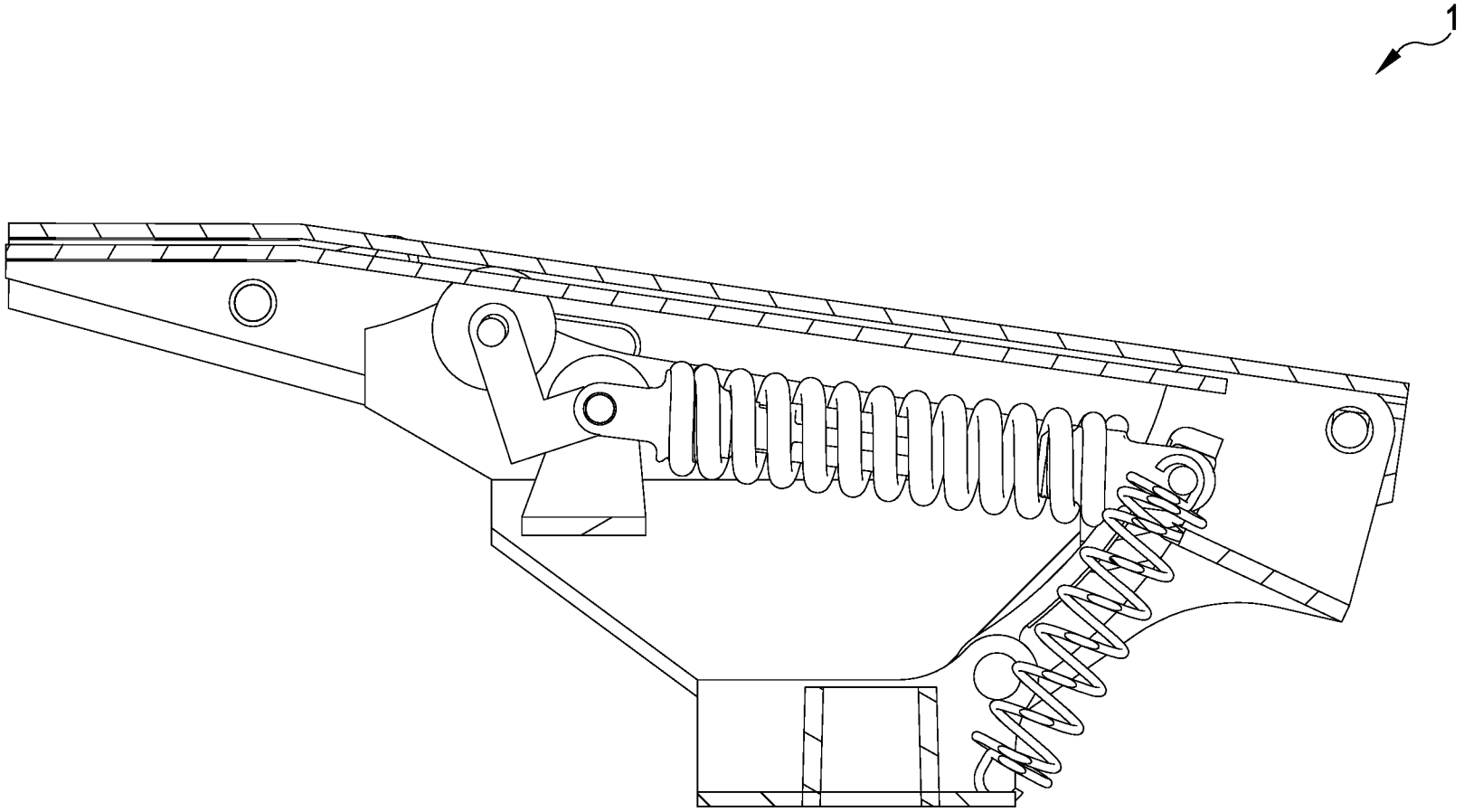
Figure 5:
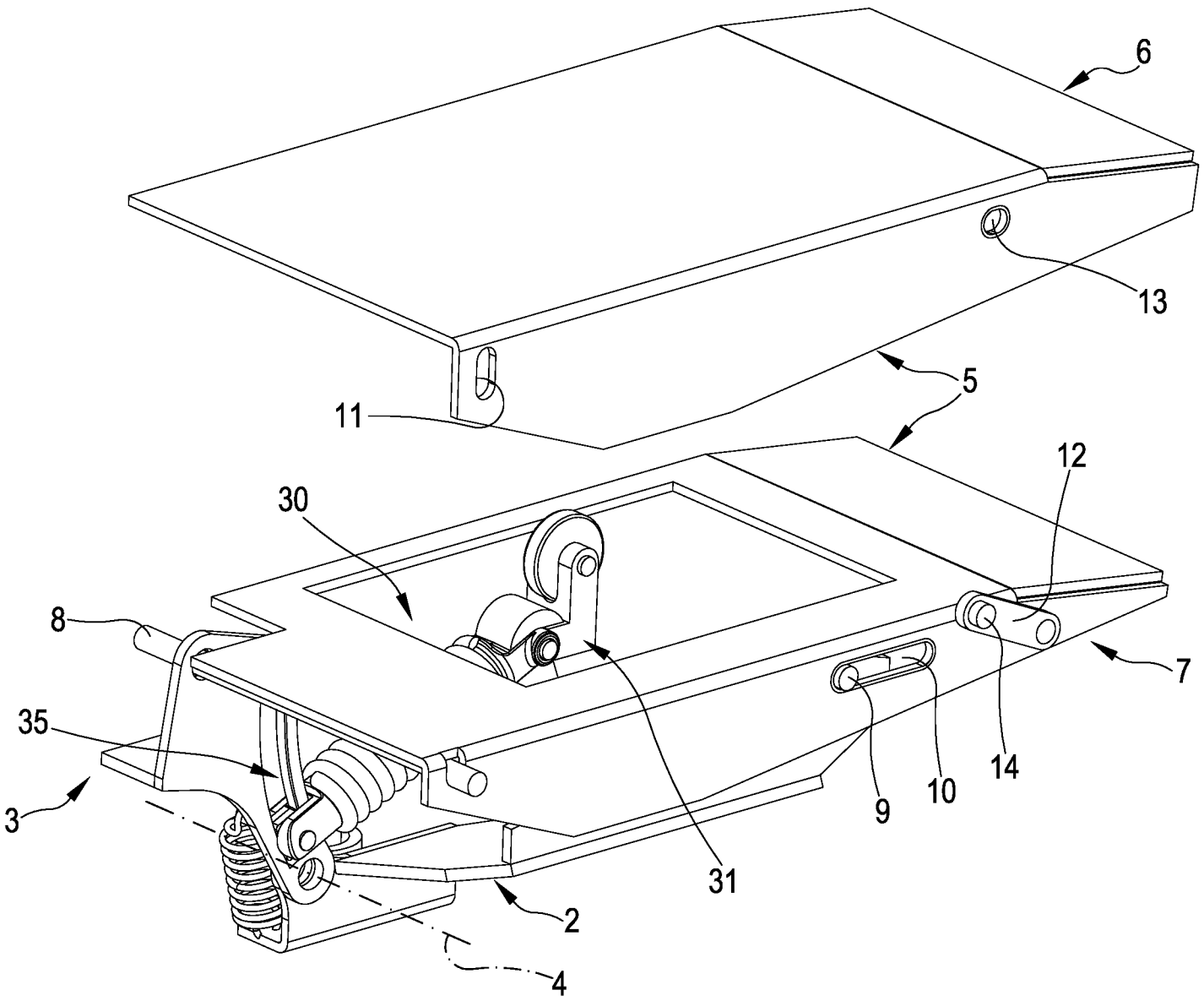
FIG. 5 schematically shows a semi-portion of the system of FIGS. 1-4, partially exploded.
Figure 6:
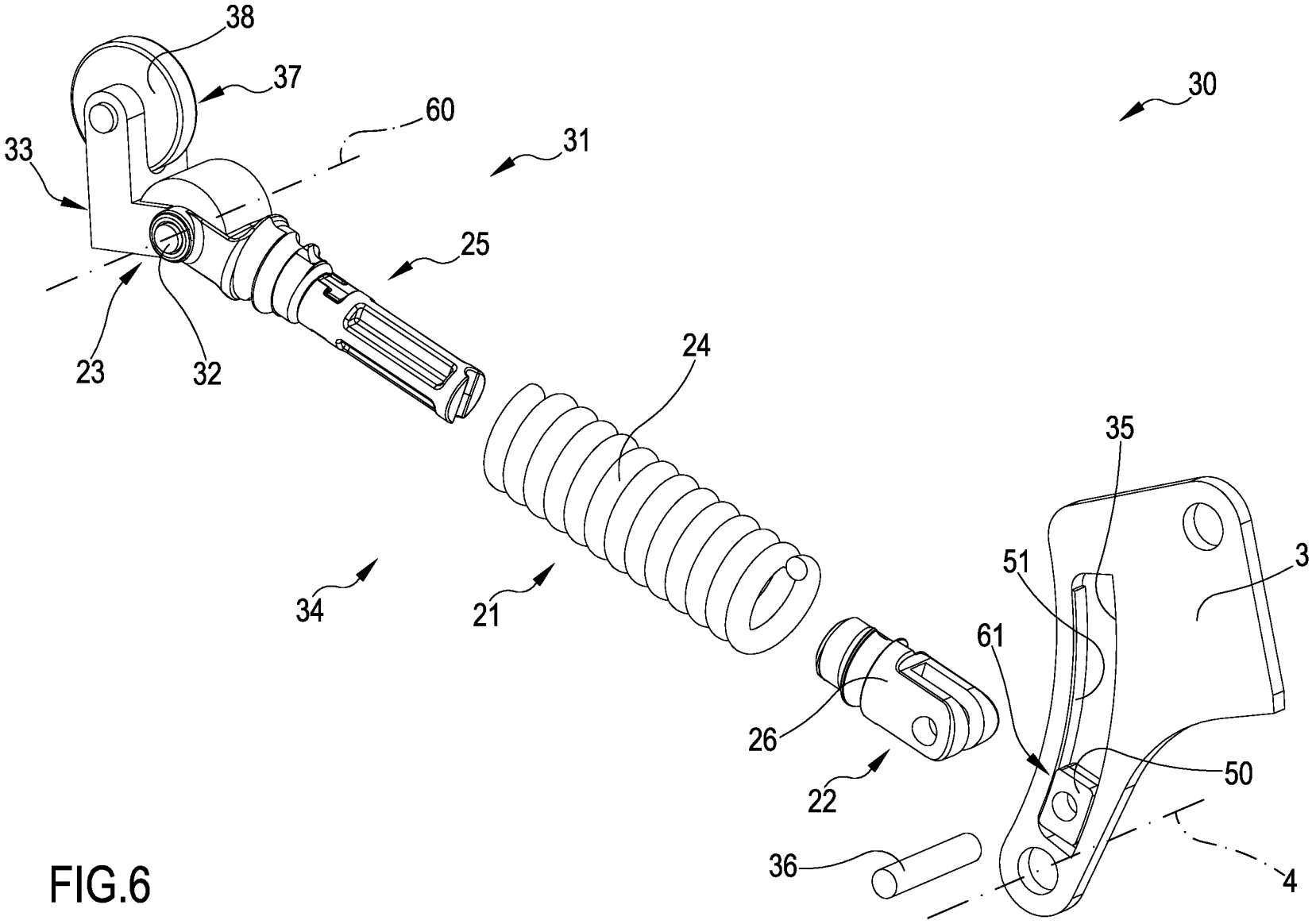
FIG. 6 schematically shows the adjustment system of the oscillation system of FIGS. 1-5, partially exploded.
Figure 10:
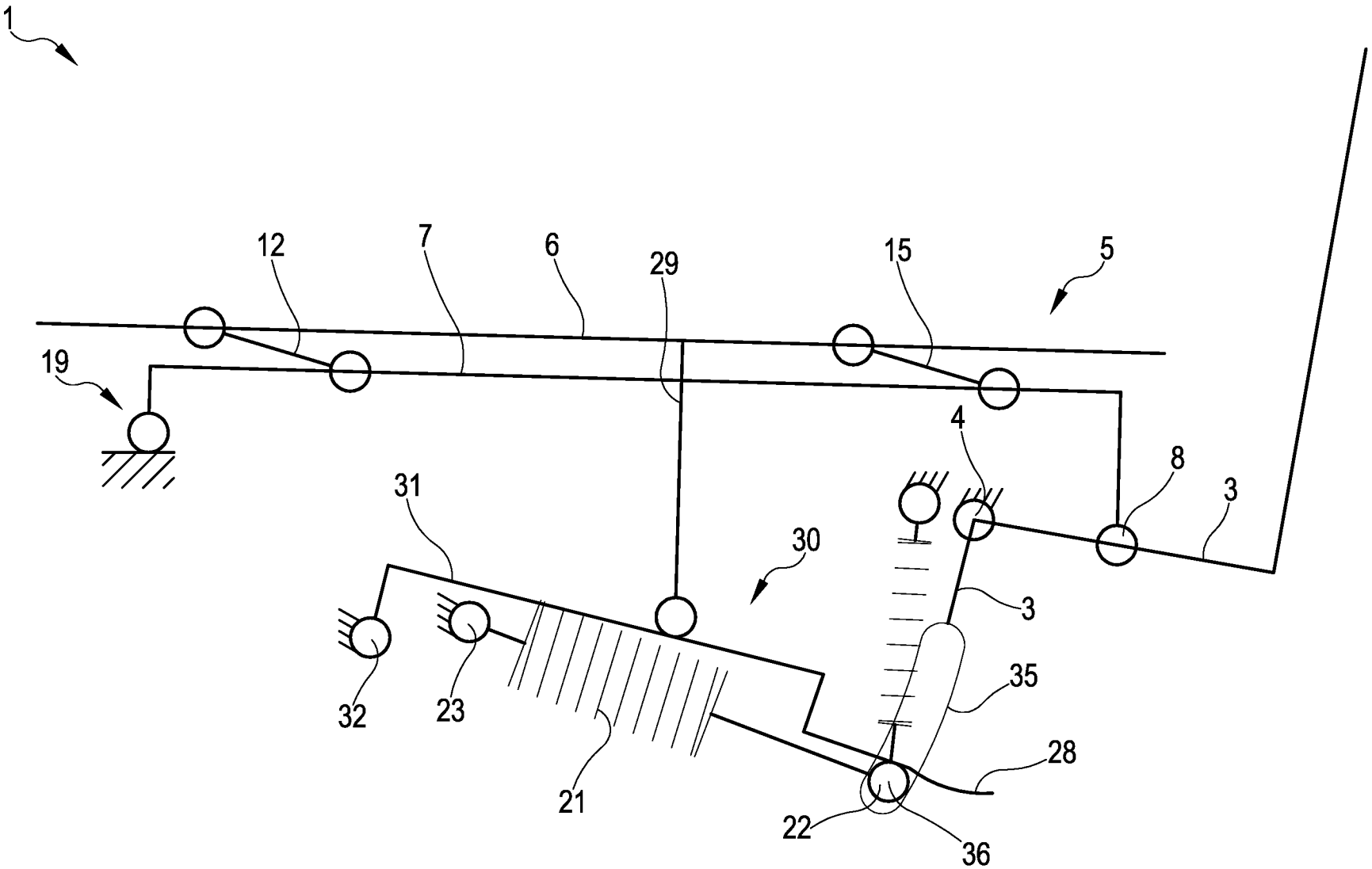

In the case of sitting of a user who weighs more than a threshold weight, the first support element 6 is lowered until the weight is balanced by the second elastic system 40, thanks to the operation of the lever member 31 of the adjustment system 30. If the weight force reaches a limit value (for example 80 kg), and for all the weight force values above this limit value, the first support element 6 reaches the minimum height position, shown in FIGS. 3 and 9, in correspondence of which the first end 22 reaches the point of end of stroke. In case of oscillation (in FIGS. 4 and 10 shown in its maximum amplitude), the oscillation system responds with a maximum reaction torque.

It is observed that the presence of the locking system of the first end 22 in the slot (as in the example of FIGS. 1-6) can determine, due to the constraints between the various components of the kinematic chain, a slight lifting of the first support element 6 during oscillation, and/or an elastic deformation of the components of the kinematic chain, such as the lever member 31 (the spring). In the event of absence of the locking system, or its action only beyond a certain oscillation, it may happen that, once the degree of stiffness in the at rest position has been self-adjusted as described above, during the oscillation a shift of the first end 22 along the slot occurs, due to the constraints between the various components of the kinematic chain, as shown for example in FIGS. 7-10. In this case, which is part of the present invention, a further adjustment of the stiffness during the oscillation is carried out, for example a (further) increase in stiffness as the oscillation increases. From a comparison between FIGS. 2 and 4, as well as 8 and 10, it can be seen that, in addition to the variation of the elastic force arm developed by the first elastic element, the present invention also synergistically provides a variation of the degree of extension of the first elastic element (much greater in FIGS. 4 and 10 with respect to FIGS. 2 and 8, respectively).

In the illustrated and described embodiments, the backrest support 3 is rigid and rotates rigidly around the axis of rotation 4.

In alternative embodiments of the present invention, not shown, the backrest support is composed of several articulated elements, at least one of which can rotate around the aforementioned axis of rotation 4. For example, as shown in WO2009/153811 (to which reference is made for constructive details), the backrest support comprises a support body designed to be rigidly fixed to the backrest (which in this case can rotationally translate rather than simply rotating around the axis of rotation), and a kinematic mechanism for connection to the frame (to form, for example, an articulated quadrilateral) in which at least one element (e.g. a connecting rod) is hinged directly to the frame to be able to rotate about the axis of rotation. In this case preferably the first elastic system can be abutted to said at least one element.

The present invention also comprises solutions, not shown, wherein the development of the slot is different from the shown arc of a circle, for example for the purpose of also varying the preload of the first elastic element in the at rest position. For example, if the slot 35 is rectilinear instead of an arc of a circle, during the adjustment by the adjustment system 30 the degree of deformation of the spring varies.

The invention claimed is:

1. An oscillation system for chairs, comprising:

a frame configured for a base of a chair;

a backrest support mounted on the frame to oscillate about an axis of rotation;

a seat support mounted on the frame and distinct from said backrest support, wherein said seat support comprises a first support element structured to be coupled to the seat and coupled to said frame to assume, given an oscillation position of the backrest support, a plurality of relative positions with respect to the frame depending on, and by effect of, a weight force applied to the first support element, wherein, for each of said relative positions, the first support element is at a respective vertical height with respect to the frame, said respective vertical heights being mutually different;

a first elastic system operatively interposed between said frame and said backrest support, comprising a first elastic element structured to oppose an elastic reaction to an oscillation of the backrest support about said axis of rotation with respect to an at rest position of the backrest support in the absence of oscillation forces, an adjustment system comprising a lever member having a fulcrum fixed to said frame and defining a fulcrum axis, wherein the lever member is physically connected to said first support element to be rotated by the first support element during a variation of the relative position while said backrest support is kept in said given oscillation position, and wherein the lever member is physically connected to a first anchoring end of said first elastic element for displacing the first anchoring end when the lever member rotates, wherein said fulcrum axis is non-coincident with said axis of rotation of the backrest support.

2. The oscillation system according to claim 1, wherein the adjustment system is structured so that, with said backrest support in said given oscillation position, a relative maximum height position of the first support element with respect to the frame corresponds to a first position of the first anchoring end of the first elastic element, for which the first elastic element opposes a first elastic reaction to the oscillation of the backrest support from the at rest position, wherein the adjustment system is structured so that, a relative minimum height position of the first support element with respect to the frame corresponds to a second position of the first anchoring end of the first elastic element, for which the first elastic element opposes a second elastic reaction to the oscillation of the backrest support from the at rest position, the second elastic reaction being greater than the first elastic reaction, wherein a distance between the first anchoring end and the axis of rotation in the second position is greater than a corresponding distance in the first position.

3. The oscillation system according to claim 1, wherein the adjustment system comprises a second elastic system, distinct from the first elastic system, having a second elastic element operatively interposed between said frame and said first anchoring end, and structured to oppose a reaction force to a displacement of the first anchoring end from said first position and/or to a displacement of said first support element from a maximum vertical height position, wherein the second elastic system is structured to maintain said first position of the first anchoring end when said weight force applied to the first support element less than or equal to a given threshold.

4. The oscillation system according to claim 1, wherein said lever member has a first arm having a respective end physically connected to said first support element to be rotated by the first support element during said variation of the relative position, and a second arm on an opposite side to the first arm with respect to the fulcrum, wherein the first anchoring end of the first elastic element is at an end of the second arm so that said rotation of the first arm induces said displacement of the first anchoring end, and wherein said axis of rotation of the backrest support is arranged in a lower and rear position of the frame, wherein said first elastic element during the oscillation is subject to a traction and wherein said first anchoring end is arranged above said axis of rotation.

5. The oscillation system according to claim 4, wherein the first elastic element belongs to the second arm, wherein a second anchoring end of the first elastic element is attached by a hinge to the frame at the fulcrum.

6. The oscillation system according to claim 4, wherein the first arm of the lever member comprises a sliding member facing the first support element and structured to allow a reciprocal movement between the first support element and the lever member during said oscillation of the backrest support and/or said variation of the relative position of the first support element, said sliding member comprising a caster wheel having an axis of rotation on said first arm of the lever member, wherein a circular peripheral surface of the caster wheel is placed in contact with said first support element.

7. The oscillation system according to claim 1, wherein said seat support comprises a second support element mounted on the frame and connected with said backrest support to move following said oscillation of the backrest support, wherein said first support element is mounted on said second support element so that, for each of said relative positions of the first support element with respect to the frame, the first support element assumes a corresponding a relative position with respect to the second support element, wherein the oscillation system comprises a kinematic connecting mechanism between the first support element and the second support element, or the frame, structured to allow, with the backrest support in said given oscillation position, a relative motion of the first support element with respect to the second support element, or to the frame, having at least one substantially vertical component, to implement said plurality of relative positions.

8. The oscillation system according to claim 7, wherein the first elastic system is physically interposed between said frame and at least one of said backrest support and said second support element, wherein the adjustment system comprises a slot in at least one of said backrest support and said second support element, and a first pin slidable along said slot, wherein said first anchoring end of the first elastic element said first pin.

9. The oscillation system according to claim 8, wherein said slot, in said at rest position of the backrest support, forms an arc of a circle with a centre in said second anchoring end, and wherein said axis of rotation lies on an extension of said arc of a circle.

10. A chair comprising a floor resting base, a stem mounted on the floor resting base, the oscillation system according to claim 1, a seat rigidly coupled to said first support element and a backrest rigidly coupled to said backrest support, wherein said frame is rigidly mounted on said stem.

11. The oscillation system according to claim 1, wherein said given oscillation position is said at rest position.

* * * * *